United States Patent [19]

Teetor

[11] 3,986,232

[45] Oct. 19, 1976

[54] BOOK PAGE HOLDER

[76] Inventor: Macy O. Teetor, 24 Orpheum Ave., Metairie, La. 70005

[22] Filed: June 18, 1975

[21] Appl. No.: 588,046

[52] U.S. Cl. ..... 24/67 R; 248/448
[51] Int. Cl.[2] ..... B42F 1/00
[58] Field of Search..... 24/81 DM, 81 CR, 81 PC, 24/81 B, 67 R; 248/448

[56] References Cited

UNITED STATES PATENTS

| | | | |
|---|---|---|---|
| 1,959,843 | 5/1934 | Sprague | 248/448 |
| 3,315,325 | 4/1967 | Cornelius | 24/67 AR |
| 3,555,622 | 1/1971 | Christian | 24/67 R |

FOREIGN PATENTS OR APPLICATIONS

| | | | |
|---|---|---|---|
| 456,528 | 2/1928 | Germany | 24/81 PC |

*Primary Examiner*—Werner H. Schroeder
*Assistant Examiner*—Doris L. Troutman
*Attorney, Agent, or Firm*—Hibben, Noyes & Bicknell, Ltd.

[57] ABSTRACT

A book page holder for holding a book in open position for reading while permitting the pages of the book to be easily turned without damage. The holder includes an elongated member that is adapted to extend laterally across the back of the book when the latter is open for reading, and a pair of clips are provided on the left and right ends of the elongated member for engaging the pages of the left and right halves of the book to prevent unintentional turning of the pages. The left clip extends laterally inwardly over the side edge of the left half of the book and the right clip extends longitudinally inwardly over the upper marginal edge of the right half of the book.

9 Claims, 7 Drawing Figures

10
11
17
18
20
21
22
23
24
25
30
31
32
33
34
35
50
51
52
53
54
55
57
B

BOOK PAGE HOLDER

This invention relates to reading assistance devices, and more particularly relates to a device for holding a book in an open position convenient for reading while permitting turning of the pages of the book while the latter is held in an open position without damaging the pages.

Various types of reading devices have been heretofore developed for holding a book in an open position to facilitate reading of the same. However, many of these devices have not proved satisfactory for various reasons such as difficulty in engaging the device with or disengaging the same from a book, difficulty in turning and damage to the pages of a book when the device is engaged therewith, fragility of construction, and high cost.

Accordingly, it is a general object of the present invention to provide a novel and improved book page holder which is free of the aforementioned disadvantages of the prior art.

Another object is to provide a novel book page holder which may be easily engaged with and disengaged from a book and which holds the pages of the book in an easily readable position when the holder is in use.

A further object is to provide a novel book page holder of the foregoing character, which permits rapid turning of the pages of the book without wrinkling or tearing.

A more particular object is to provide a novel book page holder of the character described, which is particularly adapted for use with paper back or other soft cover books.

These and other objects will become apparent from the following detailed description and accompanying sheet of drawings, wherein.

Figures 1, 2, 3, 4, 5, 6, 7:
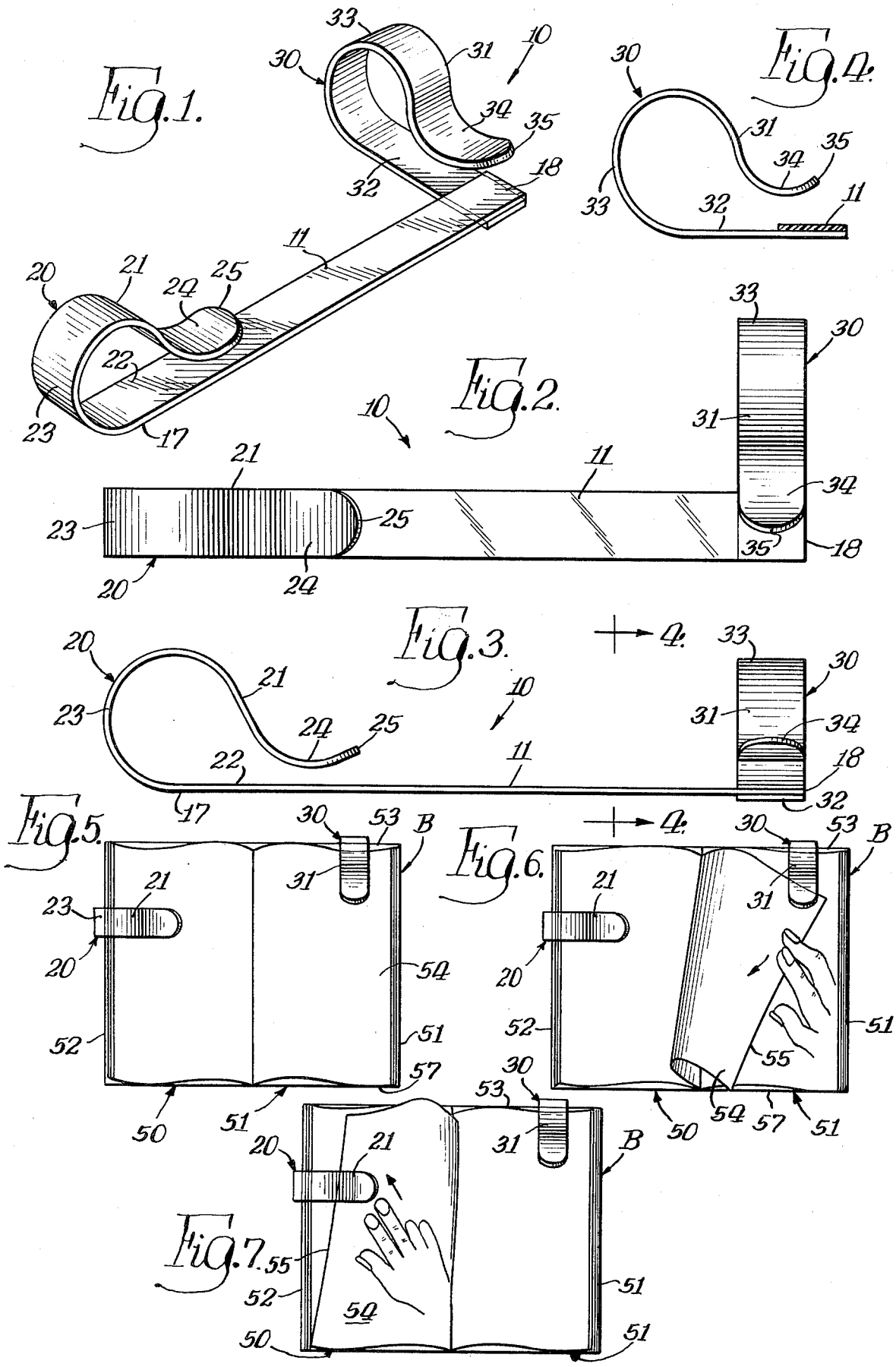
FIG. 1 is a perspective view of a book page holder embodying the features of the present invention.
FIGS. 2 and 3 are somewhat enlarged top plan and front elevational views, respectively, of the book page holder illustrated in FIG. 1.
FIG. 4 is a sectional view taken along the line 4—4 of FIG. 3.
FIG. 5 is a plan view showing the book page holder of the present invention as it would appear when in operation and engaged with a book.
FIG. 6 is a view similar to FIG. 5 but showing the manner in which the upper page of the right half of the book is disengaged from under the clip at the right end of the holder.
FIG. 7 is a view similar to FIG. 6 but showing the manner in which a turned page is engaged under the clip at the left end of the holder.

In FIGS. 1–4, inclusive, a book page holder embodying the features of the present invention is illustrated and indicated generally at 10. The holder 10, in the present instance, comprises an elongated member 11, which is preferably a strap-like or bar form and of a material capable of some degree of bending and flexure. Specifically, the member 11 is preferably of a flexible transparent plastic material, although other materials could also be used. One such plastic material suitable for use in the construction of the holder 10 is sold under the tradename Plexiglass and is manufactured by the Rohm & Haas Co. of Philadelphia, Pennsylvania.

Retaining means in the form of a pair of clips 20 and 30 are respectively provided on the left end, indicated at 17, and the right end, indicated at 18, of the member 11 for engaging the pages of a book and holding the latter in an open, reading position.

The clip 20, in the present instance, is provided by a portion of the material of the elongated member 11, which is bent or otherwise formed into a loop at the left end 17 of the member 11. The portion 21 of the clip 13 thus comprises a movable leg of the clip and the underlying portion, indicated at 22, of the elongated member 11 comprises another leg of the clip 20, which is substantially fixed relative to the member 11. The movable leg 21 is connected to the fixed leg 22 by a resilient loop 23, which causes the end portion, indicated at 24, of the movable leg 21 to be biased toward the fixed leg 22 with an increasing force as the movable leg is displaced away from the fixed leg.

The end portion 24 of the movable leg 21 is preferably formed with a slight reflex bend so that the remote outer end, indicated at 25, of the end portion 24 is spaced farther away from the elongated member 11 than the portion adjacent thereto. Consequently, the pages of an associated book may be more easily moved under the end portion 24 and into the loop 23 of the clip 20. While the movable leg 21 of the clip 20 is shown slightly spaced from the fixed leg 22 it could, and preferably is, in contact with the fixed leg.

The clip 30 is likewise in the form of a loop defined by a movable leg 31 and another leg 32, which is substantially fixed relative to the leg 31. The movable leg 31 is connected to the fixed leg 32 by a resilient loop 33, which causes the end, indicated at 33, of the movable leg 31 to be biased toward the fixed leg 32 with an increasing force as the movable leg is displaced away from the fixed leg.

The end portion, indicated at 34, of the movable leg 31 is preferably formed with a reflex bend so that the remote outer end, indicated at 35, of the end portion 34 is spaced a greater distance from the elongated member 11 than the end portion 34. Consequently, the pages of an associated book may be more easily moved under the end portion 33 and into the loop of the clip 30. While the movable leg 31 of the clip 30 is shown slightly spaced from the fixed leg 32, it could, and preferably is, in contact with the fixed leg.

The clip 30 is secured to the right end 18 of the member 11 so that the legs 31 and 32 extend perpendicularly to the body member 11, as viewed in FIG. 2. In the preferred construction the end of the fixed leg 32 is secured to the underside of the right end 18 of the elongated member 11, as by cementing, so that legs 31 and 32 of the clip 30 extend upwardly from the member 11, as shown in FIG. 2.

Referring now to FIGS. 5–7, inclusive, in conjunction with FIGS. 1–4, inclusive, the mode of operation of the book page holder 10 will now be described.

Assuming that it is desired to engage the holder 10 with a book, such as a paper back book indicated at B in FIGS. 5–7, inclusive, the user will first open the book to the desired page and then engage either the clip 20 with the pages of the left half, indicated at 50, of the book, or engage the clip 30 with the pages of the right half, indicated at 51, of the book B to hold the latter at a desired open place. When the clips 20 and 30 are engaged with their respective halves 50 and 51 of the book, the left clip 20 will extend inwardly over the left side edge, indicated at 52, of the book and embrace the pages of the left half 50 thereof, somewhat above the horizontal center of the book, and the right clip 30 will extend inwardly over the upper marginal edge, indicated at 53, of the right half 51 of the book and embrace the pages thereof in clamping relation at a point somewhat above the horizontal center of the book. The compressive force of the flexible leg portions 21 and 31 of the clamps 20 and 30 is sufficient to prevent movement of the pages of the book halves 50 and 51 and also to hold the book in an open, reading position.

When the user desires to turn a page of the book, he merely exerts a downward and inward force on the upper page, indicated at 54, of the pages of the right half 51, as shown in FIG. 6, until the page 54 is disengaged from the clip 30. The page is then shifted over toward the left half 50 of the book and the outer or left side edge, indicated at 55, of the page is slipped under the flexible leg 21 of the clip 20, in the manner illustrated in FIG. 7. When the turned page 54 is shifted fully under the flexible leg 21, it will be retained in this position by the clip 20 without additional effort on the part of the reader. The stiffness of the elongated member or bar portion 11 of the holder 10 is sufficient to retain the halves 50 and 51 of the book in a substantially horizontal plane, regardless of the place that the reader is reading in the book.

While the compressive force of the leg portions 21 and 31 of the holder 10 is sufficient to retain the holder in its operating position illustrated in FIG. 5 without any substantial degree of shifting while the pages are being turned, some shifting of the holder 10 may occur due to different surface finishes and/or thickness of the pages of different types of books. Should this happen, the holder 10 may be retained in its desired operating position on a book if the reader applies a slight amount of laterally inward pressure on the loop 23 of the left clip 20 while turning the pages.

While the holder 10 of the present invention is particularly suited for use in holding the pages of paper back books, it may also be used with hard cover books of approximately the same size as paper back books, although the binding of hard cover books may result in the halves of such books being less flat than a comparably sized paper back book.

It should also be understood that while the clip 30 of the holder 10 has been herein described as being connected to the end 18 of the elongated member 11 so that the legs 31 and 32 thereof extend perpendicularly upwardly from the member 11 and thus permit the clip 30 to extend inwardly over the upper marginal edge 53 of the book half 51, the clip 30 could also be connected to the end 18 of the member 11 so that the legs 31 and 32 of the clip 30 extend perpendicularly downwardly from the member 11. With this arrangement the clip 30 would extend inwardly over the lower marginal edge, indicated at 57 in FIGS. 5 and 6, of the book half 51. The pages of the half 51 of the book would, therefore, be disengaged from the latter position of the clip 30 by an upward and inward movement, instead of a downward and inward movement, as shown by the arrow in FIG. 6.

While only one embodiment of the invention has been herein illustrated and described in detail, it will be understood that modifications and variations thereof may be effected without departing from the scope of the invention as exemplified in the appended claims.

I claim:

1. A book page holder for holding a book in an open position to facilitate reading thereof and to facilitate turning of the pages of the book while the latter is held in an open position, said book having left and right halves when in an open position, each of said halves having upper and lower marginal edges and a laterally outer side edge, said holder comprising an elongated member adapted to extend laterally across the outer sides of the front and rear covers of the book when the latter is in an open position and having left and right ends, and retaining means carried at each of said ends for engaging and preventing turning of the pages of the left and right halves of said book, the retaining means at the left end of said elongated member being adapted to extend laterally inwardly over the outer side edge of the left half of said book and the retaining means at the right end of said elongated member being adapted to extend perpendicularly to said elongated member and longitudinally inwardly over one of said upper and lower marginal edges of the right half of said book.

2. The book page holder of claim 1, in which said retaining means at the right end of said elongated member is adapted to extend inwardly over the upper marginal edge of the right half of said book.

3. The book page holder of claim 1, in which said retaining means comprises a clip on each of the respective ends of said elongated member.

4. The book page holder of claim 3, in which each of said clips has a leg fixed with respect to said elongated member and another leg movable toward and away from said fixed leg, and said movable leg has an end portion disposed closely adjacent to and resisting displacement away from said fixed leg, whereby said movable leg exerts a compressive retaining force on the pages of said book disposed between said legs preventing said unintentional turning.

5. The book page holder of claim 4, in which said fixed and movable legs are integrally connected by a resilient loop portion, said resilient portion providing said compressive retaining force upon displacement of said movable leg away from said fixed leg.

6. The book page holder of claim 4, in which the legs of the clip at the left end of said elongated member extend in a direction generally coextensive with said elongated member, and the legs of the clip at the right end of said elongated member extend in a direction generally perpendicular to said elongated member.

7. The book page holder of claim 4, in which the clip at the left end of said elongated member is formed integrally therewith and the clip at the right end of said elongated member is separate from but permanently secured to said member.

8. The book page holder of claim 4, in which at least the movable leg of each of said clips is of transparent material.

9. The book page holder of claim 8, in which said clips and said elongated member are of transparent material.

* * * * *